US006516869B2

(12) United States Patent
Crivellone et al.

(10) Patent No.: US 6,516,869 B2
(45) Date of Patent: Feb. 11, 2003

(54) MOULD STRUCTURE FOR PRODUCING LIGHT METAL ALLOY CASTS AND A LOW PRESSURE PRECISION CASTING METHOD IN A SEMI PERMANENT MOULD

(75) Inventors: Gianni Crivellone, Turin (IT); Sergio Gallo, Turin (IT); Claudio Mus, Aosta (IT)

(73) Assignee: Teksid Aluminum S.p.A., Carmagnola (IT)

( * ) Notice: Subject to any disclaimer, the term of this patent is extended or adjusted under 35 U.S.C. 154(b) by 0 days.

(21) Appl. No.: 09/949,075

(22) Filed: Sep. 10, 2001

(65) Prior Publication Data

US 2002/0108737 A1 Aug. 15, 2002

(30) Foreign Application Priority Data

Feb. 15, 2001 (IT) ..... T001A0135

(51) Int. Cl.[7] ..... B22D 33/04

(52) U.S. Cl. ..... 164/340; 164/369; 164/397; 164/137

(58) Field of Search ..... 164/137, 340, 164/369, 397, 400

(56) References Cited

U.S. PATENT DOCUMENTS

| | | | |
|---|---|---|---|
| 451,578 | A | 5/1891 | Richards |
| 853,490 | A | 5/1907 | West |
| 1,747,223 | A | 2/1930 | Campbell |
| 1,850,477 | A | 3/1932 | Roth |
| 3,265,348 | A | 8/1966 | Sylvester |
| 3,774,668 | A | 11/1973 | Iten et al. |
| 3,863,704 | A | 2/1975 | Kahn |
| 3,882,942 | A | 5/1975 | Rohatgi et al. |
| 3,929,184 | A | 12/1975 | Reuter et al. |
| 4,008,749 | A | 2/1977 | Bellocci et al. |
| 4,733,714 | A | 3/1988 | Smith |
| 4,875,518 | A | 10/1989 | Imura et al. |
| 4,993,473 | A | 2/1991 | Newcomb |
| 5,072,773 | A | 12/1991 | Ruff et al. |
| 5,297,611 | A | 3/1994 | Legge et al. |
| 5,477,906 | A | 12/1995 | Legge et al. |
| 5,590,681 | A | 1/1997 | Schaefer et al. |
| 5,725,043 | A | 3/1998 | Schaefer et al. |

FOREIGN PATENT DOCUMENTS

| | | |
|---|---|---|
| AU | 19788 | 10/1935 |
| DE | 352309 | 4/1922 |

(List continued on next page.)

OTHER PUBLICATIONS

Campbell, "Solidification Dynamics", Castings, 1991, pp. 131–133 and 230, Butterworth–Heinemann Ltd., Oxford, U.S.A.

Beeley, "Solifidication 2: The Feeding of Castings", Foundry Technology, pp. 128–131, Newnes–Butterworths.

(List continued on next page.)

*Primary Examiner*—Kuang Y. Lin
(74) *Attorney, Agent, or Firm*—Sughrue Mion, PLLC

(57) ABSTRACT

A mould structure for producing metal castings by solidifying molten metal, in particular for producing a light-alloy engine crank-case, which includes a plurality of cores defining a mould cavity and a primary inlet aperture for feeding the molten metal into the bottom region of the mould cavity through the walls of one of the said cores, which includes: a metal containment structure, open at the top, with a bottom wall and side walls having a plurality of reference elements which have surface portions which complement surface portions of the said cores, the said cores being assembled inside the containment structure so that they are engaged with each other and with the said reference elements, and being shaped so as to define interstices between their surfaces facing outwardly of the mould cavity and the walls of the containment structure; and at least one cover element made of a highly heat-conductive material, supported by the side walls of the containment structure and by some of the said cores and serving to close the top of the mould cavity.

11 Claims, 3 Drawing Sheets

FOREIGN PATENT DOCUMENTS

| | | | |
|---|---|---|---|
| DE | 477 287 | | 6/1929 |
| DE | 529 838 | | 7/1931 |
| DE | 680 515 | | 8/1939 |
| DE | 2 147 678 | | 4/1972 |
| DE | 24 08 032 | A1 | 9/1975 |
| DE | 35 43 194 | * | 11/1986 |
| EP | 0 183 761 | B1 | 2/1989 |
| EP | 0 557 374 | | 7/1997 |
| FR | 611853 | | 10/1926 |
| FR | 1.100.788 | | 9/1955 |
| GB | 520598 | | 4/1940 |
| GB | 1028736 | | 3/1965 |
| GB | 1028736 | | 5/1966 |
| GB | 2 080 714 | A | 2/1982 |
| GB | 2 187 984 | A | 9/1987 |
| JP | 53-11830 | | 2/1978 |
| JP | 55-136556 | | 10/1980 |
| JP | 59-44365 | | 3/1984 |
| JP | 61-23565 | | 2/1986 |
| JP | 64-53758 | | 3/1989 |
| JP | 2-192872 | | 7/1990 |

OTHER PUBLICATIONS

Heine, et al., "Principles of Metal Casting", Principles of Metal Casting, 1967, pp. 244–247, McGraw–Hill, Inc., U.S.A.

Smith, et al., "Low Pressure Sand Casting: Current Experience With a New Process", AFS Transactions, pp. 785–792.

Hetke, "Aluminum Casting Quality in Alloy 356 Engine Components", ICA Castings Intermet–Comalco Aluminum, pp. 1–24.

Plutshack, et al., "Riser Design", Metals Handbook Ninth Edition, 1988, pp. 577–588, vol. 15, ASM International, U.S.A.

Sokolowski, et al., "Analysis of the Controlled Solidfication Process of 1.6 L Cylinder Head Castings", Current Aluminum Research and Applications 87, 1988, pp. 41–44, American Foundrymen's Society, Inc., U.S.A.

Jorstad, et al., Aluminum Casting Technology, 1993, pp. 280–281, American Foundrymen's Society, Inc., U.S.A.

Casting Kaiser Aluminum, 1974, pp. 340–345 and 426–431, Kaiser Aluminum & Chemical Sales, Inc., Oakland, U.S.A.

Aluminum Castings Technology, 1986, pp. 178–181, American Foundrymen's Society, Inc., Des Plaines, U.S.A.

Lavington, "The Cosworth Process—A New Concept in Aluminum Alloy Casting Production".

* cited by examiner

MOULD STRUCTURE FOR PRODUCING LIGHT METAL ALLOY CASTS AND A LOW PRESSURE PRECISION CASTING METHOD IN A SEMI PERMANENT MOULD

BACKGROUND OF THE INVENTION

The present invention relates to a mould structure for producing metal casts obtained by the solidification of molten metal, and to a casting method which uses such a structure.

In particular, the invention relates to the production of light metal alloy casts such as, for example, the crankcase of an internal combustion engine.

The mould structure one the invention is intended to be used in a low-pressure castling method, the general characteristics of which are well known in the art.

SUMMARY OF THE INVENTION

According to this method, the molten metal is fed into the mould through an inlet formed in the bottom of the mould cavity and fills this cavity from below, the molten metal is fed from a furnace positioned beneath the mould, either by means of a pump or by pressurizing the furnace so that the molten metal flows up inside the mould.

Low-pressure casting methods of the type described above are described, for example, in GB 1028736 and in EP-B-0 183 761.

U.S. Pat. No. 4,733,714 describes an improved method of low-pressure a primary source through an inlet below the top of the mould cavity the mould is then turned over in order to prevent the molten metal from flowing back from the mould cavity towards the primary source, and also to enable metal to flow into the cavity from a secondary source, constituted by a feed-head full of molten metal, keeping the mould cavity in continuous communication with the primary source while the mould is turned over. The mould cavity is then disconnected from the primary source and moved to a cooling station where the molten metal—contained in the secondary source—can flow into the mould while the metal solidifies.

The method described above means that the casting operation is largely independent of the time required for the casting to solidify, thus improving the productivity of the casting station.

EP-B-0 557 374 describes a similar casting method to that described in U.S. Pat. No. 4,733,714, in which the mould structure has a primary inlet and a secondary system for feeding molten liquid metal into the mould cavity while the metal is solidifying, thereby;compensating for shrinkage, and has a large-surface heat extraction element which defines a portion of the mould cavity won the opposite side from the secondary feeding system and adjacent the primary inlet.

According to the above description, the heat extraction element, which is intended to be in contact with outside means for extracting heat, plays a useful role in directing the solidification of the casting. In a preferred embodiment, the mould structure has means for sealing and insulating the mould cavity from the primary source when a substantial portion of the metal fed into the mould cavity is still in a liquid state.

The primary object of the present invention is to provide a new mould structure for low—pressure casting which—the weight and dimensions of the desired casting being equal makes—makes it possible to reduce the overall weight of the mould and the production costs thereof, while at the same time making it possible to achieve optimum solidification of the casting, avoiding the production of any inaccurate structures or unwelcome porosity.

These and other objects, which will become more apparent later, are achieved according to the invention by providing a mould structure of a type which includes a plurality of cores defining a mould cavity and a primary inlet for feeding the molten metal into the bottom region of the mould cavity through the walls of one of the said cores, characterised in that it includes:

- a metal containment structure, open at the top, with a bottom wall and side walls having a plurality of reference elements with surface portions which are complementary with surface portions of the said cores, the said cores being assembled inside the containment structure so as to engage each other and the said reference elements, and being shaped so as to define interstices between their surfaces facing outwardly of the mould cavity and the walls of the containment structure, and
- at least one covering element of a material which has a high heat conductivity, supported by the side walls of the containment structure and by some of the said cores, for closing the top of the mould cavity.

A further object of the invention is to provide a low-pressure casting method, using the mould structure described above.

One particular advantage of the mould structure of the invention consists in the fact that it makes it possible to use shaped cores of bound siliceous sand which are very thin and thus light and economical, together with metal cores.

BRIEF DESCRIPTION OF THE DRAWINGS

Further advantages and characteristics of the invention will become apparent from the detailed description which follows, with reference to the appended drawings, in which.

DETAILED DESCRIPTION OF THE INVENTION

Figure 1:
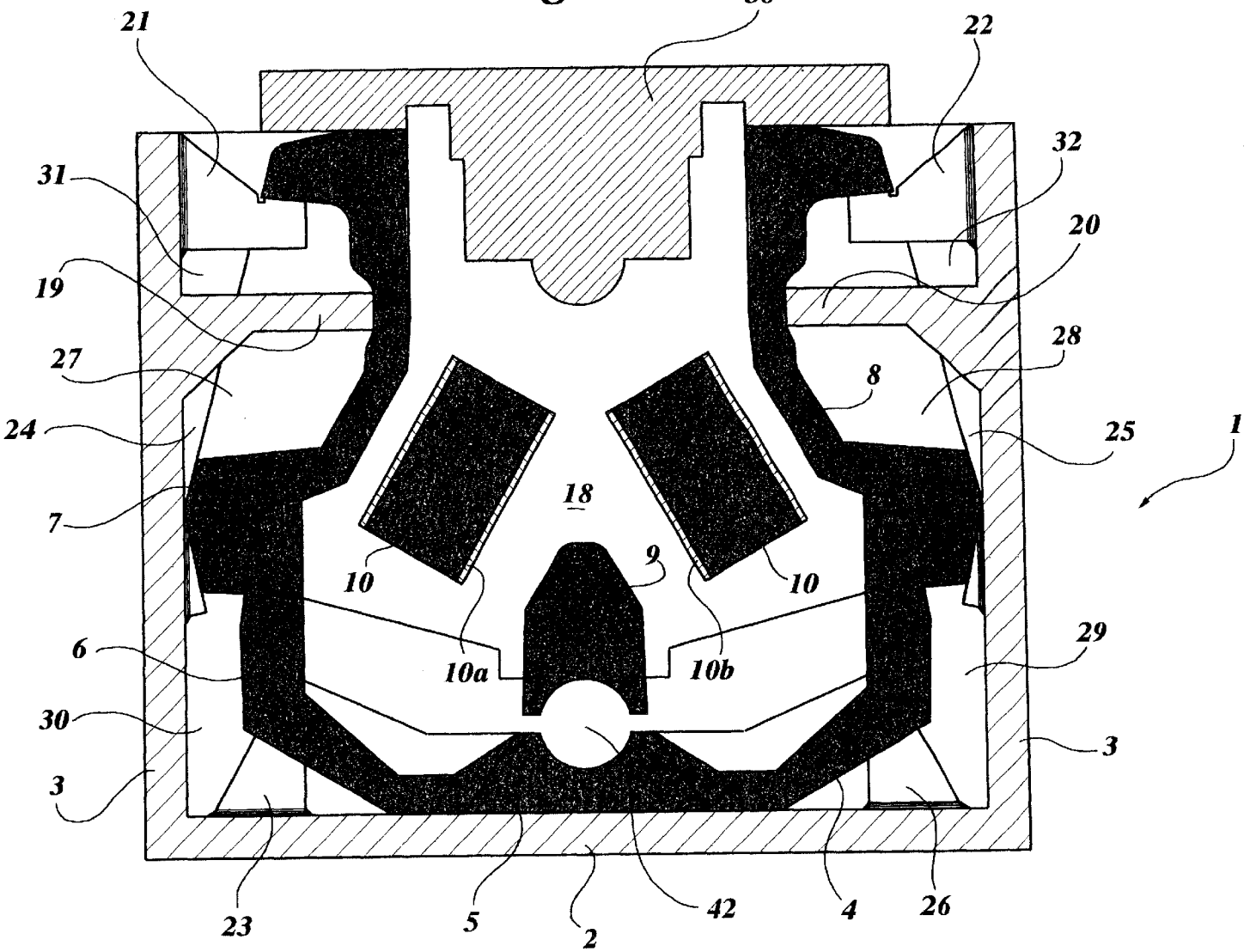
FIG. 1 is a sectioned schematic view of a mould structure according to the invention.
Figure 2:
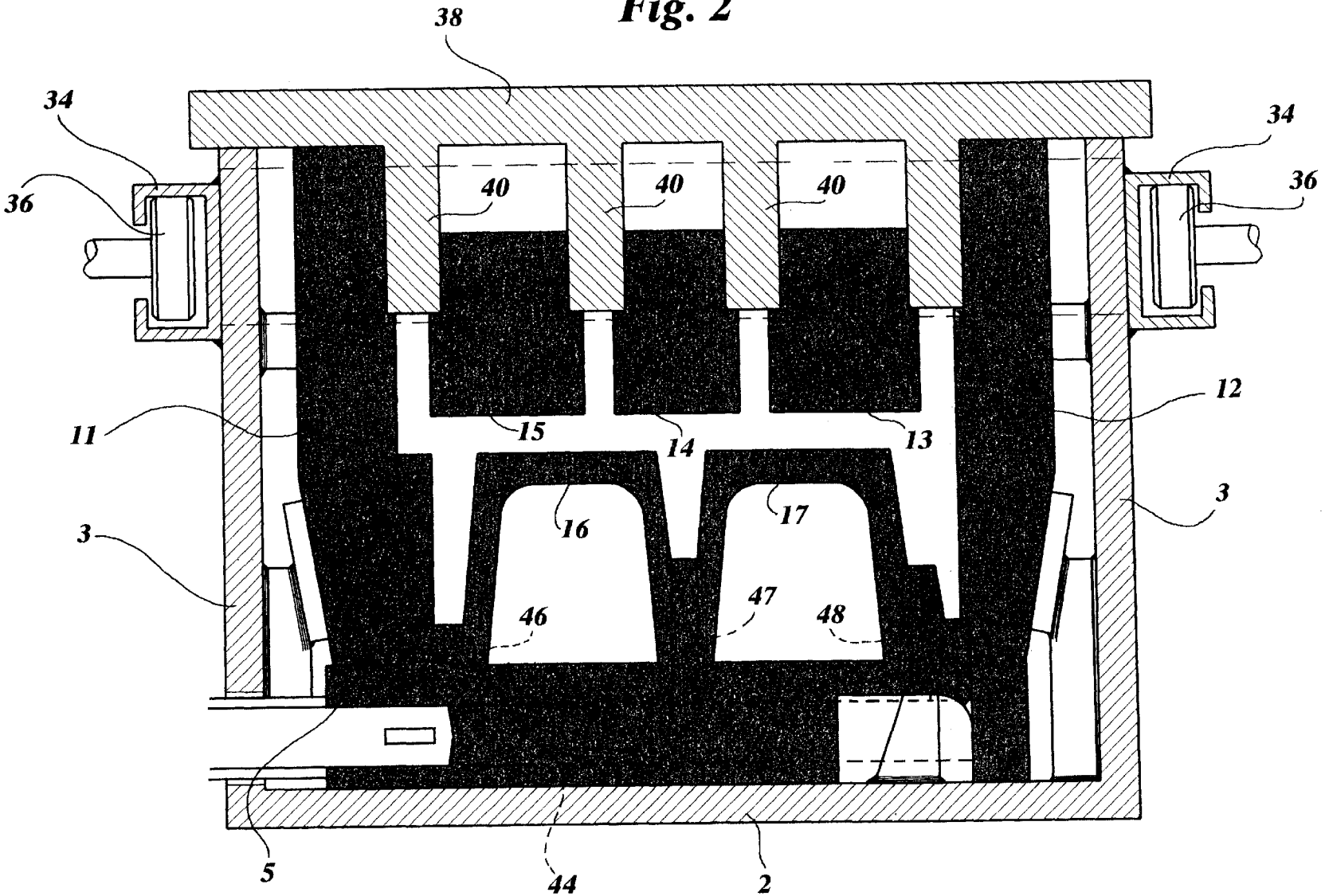
FIG. 2 is a schematic view, sectioned along the line II—II of the mould structure of FIG. 1.

The mould structure in the appended drawings is intended specifically for producing a crankcase for an internal combustion engine; it is clear, however, that the structural principles on which the invention is based could be applied just as well to the production of other metal castings.

In the drawings, a containment structure made of steel or cast iron, is indicated 1, being open at the top and having a bottom wall 2 and side walls 3. The main function of the aforesaid containment structure 1 is to enable a plurality of shaped cores 4–17 to be assembled inside it so as to define a mould cavity 18 within them. In order to produce especially complex castings, such as that shown in the drawings, a plurality of cores are used which have complementary surfaces for engagement with each other. The cores which define the outer walls of the mould cavity are typically constituted by shaped elements of bound siliceous sand, with the binder being a water-soluble protein compound or a phenolic, furane or ureic resin. However, the use of metal inserts is also advised, in particular for the innermost cores of the mould cavity, such as, for example (as shown in the appended drawing) the inserts 10*a* and 10*b* which cover the cores 10 defining the cylinders of the crank-case.

According to the innovative characteristic of the invention, the containment stricture has a plurality of reference elements 19–26, either welded to or integral with the side walls or the bottom wall of the containment structure. Portions of the surfaces of these reference elements complement portions of the surfaces of the cores which define the mould cavity, in such a way that these cores can be supported and precisely positioned within the containment structure.

Within the scope of the invention, cores are used which not only are shaped on their surfaces which define the mould cavity, but also on their outer surfaces with respect to the cavity, whereby the core define, between their surfaces facing outwardly of the mould cavity and the walls of the containment structure; interstitial regions, indicated 27–32 for example, where the cores are not in contact with the walls of the containment structure.

This makes it possible to reduce the thickness and thus the weight of the siliceous sand or other cores substantially, thereby achieving extremely accurate positioning of the cores and also speeding up assembly times.

Another role of the containment structure 1 is to enable the mould structure to be conveyed from the casting station to the downstream cooling station and then on for storage, for as long as may be required. To this end, the containment structure 1 has track elements 34 for engaging conveyor rollers 36.

The mould structure of the invention also includes a cover element 38, made of a heat conducting metal, which is provided to close the top of the mould cavity. This closure element 38 is supported by the side walls 3 of the containment structure 2 and by some of the cores 11, 12 defining the mould cavity.

The closure element 38 can also act as a support for the mould structure should it be necessary—after casting —to turn it over in order to allow the casting to solidify, as will be seen in greater detail later.

The use of a plate closure element with a cooling role, in low-pressure casting methods, is known in the art and is described, for example in GB 1028736.

With reference in particular to the production of a casting for a crankcase, as shown in the drawings, the cover element 38 has a plurality of appendages 40 of heat conductive material, extending into the mould cavity and interposed between the cores so as to close off the top of the mould cavity. These appendages 40 have only a small surface in contact with the molten metal and act as discrete cooling elements.

The mould structure: for low-pressure casting also has a primary inlet 42 for the molten metal which, when the structure is in its casting configuration, is near the bottom of the mould cavity, this inlet being formed in a core forming the base of the mould.

The inlet aperture 42 is in communication with flow channels 44 formed inside the base cores which extend longitudinally and are in communication with channels 46, 47, 48 for feeding the molten metal upwardly within the mould cavity. These channels 44 also act as a secondary source for feeding the molten metal during the solidification step of the casting operation, if the mould structure has been rolled over.

In order to carry out the casting operation, the core elements are first assembled inside the containment structure 1: thanks to the reference elements in the containment structure, this operation is extremely fast and simple; finally the cover element 38 is placed in position, closing the mould cavity. Once the cover element is in place, the entire assembly constituted by the containment structure, the cores and the cover element is locked together with metal straps or other binding elements, in order to prevent any relative movement of the constituent parts and to ensure that the casting proceeds accurately.

The strapped mould structure is then conveyed, suspended on rollers 36 engaged in the track elements 34, to a casting station 50 where a loading device places the mould structure in the correct position for casting.

Figure 3:
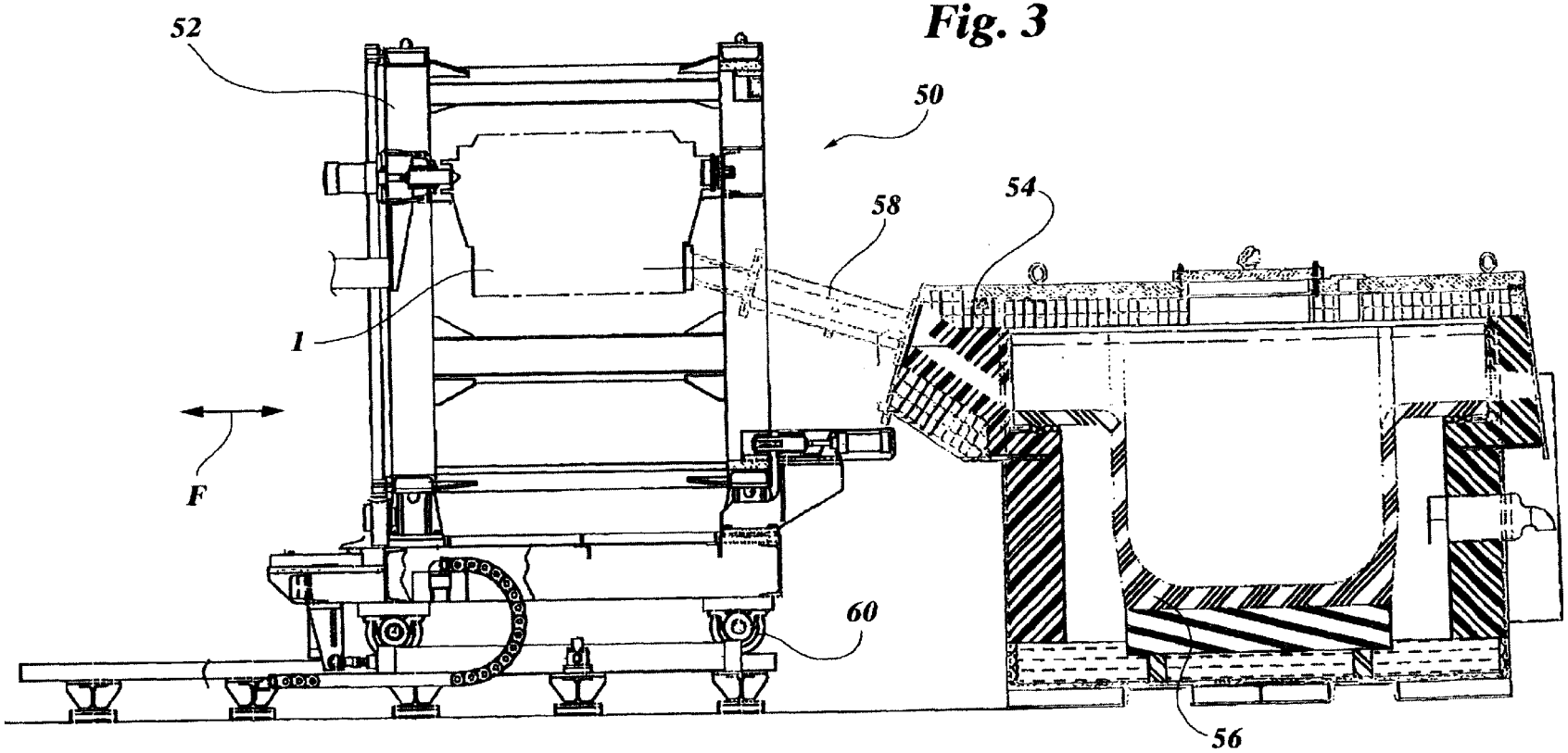
FIG. 3 is a schematic illustration of machinery for performing the method.

The casting station, illustrated schematically in FIG. 3, includes a frame 52 for holding the mould structure 1 in the casting position and low-pressure casting apparatus 54, operable to melt the metal and feed it into the mould.

The casting apparatus may be constituted, for example, by low-pressure casting apparatus such as that described in the U.S. Pat. No. 5,590,681 and U.S. Pat. No. 5,725,043. This casting apparatus includes a smelting furnace which feeds the molten metal to a low-presure crucible 56 through a channel which includes an on-off valve assembly which, in its closed position, prevents they molten metal flowing from the smelting furnace to the feeding crucible.

With the on-off valve assembly in its closed position, pressurized gas is fed into the crucible 56, in order to pump the molten metal into the mould through a rising channel 58 connected to the inlet aperture 42 of the mould structure.

During the casting operation, the molten metal fills the mould cavity through the channels 44, 46, 47 and 48. In a preferred, but not essential embodiment of the invention, once the mould is full, it is possible to roll over the mould structure, turning it through 180° C. In this event, during the roll-over operation, or immediately afterwards, the feed crucible 56 is depressurized, allowing the metal contained in the channel 58 to flow back into the crucible, and the primary feeding channel 58 is mechanically disconnected from the mould structure.

Once this channel is disconnected and the mould structure has been rolled over through 180 °C., the channels 44 which contain molten metal act as secondary feed sources, feeding molten metal into the cavity by gravity, in order to compensate for shrinkage of the metal as it gradually solidifies.

This end, drive means (not shown) can be provided on the frame 52 for turning the mould over; in addition, the frame 52 is preferably mounted on wheels 60, so it is movable, and has motor means controlling movement of the frame along the direction of the arrow F, away from the primary source 58 and thereby disconnecting the channel.

After the casting operation, and once it has been inverted, if appropriate, the mould structure is ready to be transferred to a cooling station, while a new mould structure can be loaded into the casting position onto the frame 52.

Thanks to the mould structure of the invention, and in particular to the lightness of the cores forming the mould cavity, which makes thy mould structure easier to manipulate, this method achieves higher productivity without diminishing the overall reliability of the operation and ensures that the casts produced slave the desired morphological characteristics.

Naturally, the principle of the invention remaining unchanged, manufacturing details and embodiments may vary widely from those described and illustrated purely by way of non-limitative example.

In particular, the shape of the containment structure 1 could be very different from that illustrated; the walls could have openings in order to make the structure even lighter.

For example, in the case of a mould structure for the casting of an engine crank-case, the cover element 38 could be constructed as a frame with a peripheral structure and cross members bearing the discrete cooling elements 40 which close the mould cavity, thereby making the mould structure even lighter.

What is claimed is:

1. A mould structure for producing metal castings by solidifying molten metal, comprising:

a plurality of cores defining a mould cavity and a primary inlet for feeding the molten metal into the bottom of the mould cavity through the walls one of the said cores, a metal containment structure, open at the top, having a bottom wall and side walls with a plurality of reference elements having surface portions which complement surface portions of the said cores, the said cores being assembled inside the containment structure so as to engage each other and the said reference elements and being shaped so as to define interstices between their surfaces facing outwardly of the mould cavity and the walls of the containment structure, and at least one cover element made of a highly heat-conductive material, supported by the side walls of the containment structure and by some of the said cores and serving to close the top of the mould cavity.

2. A mould structures according to claim 1, wherein the said cores defining the mould cavity comprise cores made of bound siliceous sand.

3. A mould structure according to claim 1, comprising:

a primary inlet aperture for the molten metal, which in communication with the mould cavity and formed through one of the cores, in the bottom region of the mould structure, this inlet aperture being in flow communication with channels feeding the molten metal into the mould cavity.

4. A mould structure according to claim 1, comprising metal inserts embedded in tube mould cavity.

5. A mould structure according to claim 1, wherein the said cover element is secured to the containment structure by bindings.

6. A mould structure according to claim 5, wherein the said bindings include metal straps tightened around the containment structure and the said cover element.

7. A mould structure according to claim 1, wherein the said mould cavity defines a casting for a crankcase for an internal combustion engine.

8. A mould structure, according to claim 7, wherein the said cover element includes a plurality of appendages of heat conductive material which extend into the mould cavity so as to be interposed between some of the said cores, closing the top of the mould cavity, and which act as discrete cooling elements.

9. A low-pressure precision casting method, in which the molten metal is fed at low-pressure into the mould cavity of a mould structure according to claim 1, by feeding the molten metal from a primary feed source positioned lower than the inlet aperture of the said mould structure.

10. A method according to claim 9, wherein, after the low-pressure casting operation; rolling the mould structure over through 180° C.

11. A method according to claim 10, wherein, once the mould structure has been rolled over, or during the roll over, disconnecting the primary feed source from the feed inlet of the mould structure.

* * * * *

UNITED STATES PATENT AND TRADEMARK OFFICE

CERTIFICATE OF CORRECTION

PATENT NO. : 6,516,869 B2 
DATED : February 11, 2003
INVENTOR(S) : Gianni Crivellone, Sergio Gallo and Claudio Mus It is certified that error appears in the above-identified patent and that said Letters Patent is hereby corrected as shown below:

Title page,
Item [73], Assignee, "Teksid Aluminum S.p.A., Carmagnola (IT)" to
-- Teksid Aluminium S.p.A., Carmagnola, (IT) --.

Signed and Sealed this

Eleventh Day of May, 2004

JON W. DUDAS
*Acting Director of the United States Patent and Trademark Office*